US007874965B2

(12) United States Patent
Alessandri et al.

(10) Patent No.: US 7,874,965 B2
(45) Date of Patent: Jan. 25, 2011

(54) GYMNASTIC MACHINE

(75) Inventors: Nerio Alessandri, Longiano (IT); Simone Casagrande, Rimini (IT); Roberto Maffei, Gambettola (IT)

(73) Assignee: Technogym S.p.A., Gambettola (FC) (IT)

( * ) Notice: Subject to any disclaimer, the term of this patent is extended or adjusted under 35 U.S.C. 154(b) by 948 days.

(21) Appl. No.: 11/603,667

(22) Filed: Nov. 22, 2006

(65) Prior Publication Data

US 2007/0135277 A1 Jun. 14, 2007

(30) Foreign Application Priority Data

Nov. 25, 2005 (IT) ..... RA2005A0043

(51) Int. Cl.
*A63B 21/062* (2006.01)
*A63B 21/00* (2006.01)

(52) U.S. Cl. ..... 482/103; 482/138

(58) Field of Classification Search ..... 482/131–138, 482/104, 99–103

See application file for complete search history.

(56) References Cited

U.S. PATENT DOCUMENTS

| | | | | |
|---|---|---|---|---|
| 6,488,612 | B2 * | 12/2002 | Sechrest et al. | 482/103 |
| 7,374,515 | B2 * | 5/2008 | Slawinski et al. | 482/104 |
| 2003/0032535 | A1 * | 2/2003 | Wang et al. | 482/138 |
| 2004/0138033 | A1 * | 7/2004 | Van Straaten et al. | 482/112 |

* cited by examiner

*Primary Examiner*—Fenn C Mathew
(74) *Attorney, Agent, or Firm*—Abelman, Frayne & Schwab

(57) ABSTRACT

Gymnastic machine (1) including a frame (10), at least one gymnastic implement supported by the frame (10), in association with a load group (30) to provide a resistive load to each implement (20) during the execution of a physical exercise; the load group (30) including a first circuit (40) and a second circuit (50), both having respective flexible members (41) (51); each implement (20) being coupled to a first transmission member (41) for the first circuit (40), and the second circuit (50) including at least one load unit (60) capable of exercising a resistive action on the first transmission member (41); the first circuit (40) and the second circuit (50) being interfaced mechanically with each other through modulating means (70) capable of mechanically activating the load unit (60) to regulate its intensity.

45 Claims, 7 Drawing Sheets

GYMNASTIC MACHINE

BACKGROUND OF THE INVENTION

1. Field of the Invention

The present invention relates to a gymnastic machine usable for muscular training, having a load group which has a high capacity to absorb power, and limited overall dimensions. In particular, the present invention relates to a gymnastic machine usable for muscular training, having a load group which has a high capacity to absorb power and limited overall dimensions, and is finely adjustable.

2. Description of the State of the Art

In the sector of gymnastic machines, the use is known of load groups of a gravitational nature, normally of an additive nature, by means of packs of blocks or groups of plates, though which to define the resistance to be opposed to the execution of a gymnastic exercise by a user.

The need to finely regulate the value of the mechanical resistance to be used has led some manufacturers of gymnastic machines to use load groups of pneumatic type, as for example the Italian company Air Machine, or to use loads consisting of containers fillable at will with determinate quantities of liquid. However, it is as well to state that pneumatic load groups and loads including containers fillable with determinate quantities of liquids have disadvantages which make their use not particularly agreeable in the environments in which gymnastic activity on gymnastic machines is performed professionally, as for example in the gymnasiums of so-called fitness centers, or in the gymnasiums of sports clubs.

In machines of pneumatic type, the implements are connected mechanically to pneumatic actuators which are therefore supplied by pumps of the same type. For this reason, besides the need of positioning such machines adjacent to a suitable source of electrical supply, it is as well to point out that the maintenance of these machines must be performed exclusively by experts, and therefore entails considerable expense. Furthermore, such machines are particularly noisy because of the continual alternation of pressurization and air release through the valves of the actuators themselves. Finally, the sensations at the implement are particularly far from those which users can feel when lifting a weight, and for this reason also such machines have a market limited solely to biomedical environments, in which gymnastic exercise is more a duty than a pleasure.

The load sensation which is felt when using continuously variable gravitational loads, on the other hand, is good, as in the case of machines in which the load is produced by containers fillable with variable quantities of fluid definable at will. In such cases, however, there is a fundamental need to have water available, with the aggravating factor that if the water-seals in the water filling and discharging circuit are not perfect, leakages of water can occur which, besides making the adjustment and use of the machine difficult, can create problems of stability for users who are training in the areas around the machine. Furthermore, the noisiness of the filling and emptying devices for the containers is well-known, as is the waiting time which every user of these machines must undergo with every change in the mass of liquid to be used for training. Obviously, machines with load groups including containers fillable with various quantities of liquid, and water in particular, are particularly bulky and heavy, unless the machine is connected to the water supply, which enormously restricts the possibility of locating these machines in a gymnasium or a private dwelling.

Others have designed gymnastic machines in which the resistive load is produced by springs. However, none of the prior art researched in this sector seems to provide interesting teachings for the objectives of the applicant. In fact, even considering a particularly interesting document, U.S. Pat. No. 5,637,062 in particular, the teaching we receive is to use a combination of an elastic load and an eccentric wheel which produces an increase in the extension of the springs as the exercise proceeds, in complete contrast with the requirements of the applicant.

By virtue of what has been described above, the problems of having gymnastic machines which are at the same time independent of electricity and water supply networks, and compact and noiseless, and which offer structurally the possibility of finely adjusting the training load, is at present unresolved, and represents an interesting challenge for the applicant, who has decided to tackle and resolve it, as will be described below, in order to exploit it economically.

In view of the situation described above, it would be desirable to provide a gymnastic machine having a load group which, besides limiting the disadvantages, typical of the state of the known art set forth above, and if possible overcoming them, could define a new standard in this sector of the market. Consequently, such a gymnastic machine would prove to be suitable for installation in either a biomedical, or a sporting, or a domestic environment, and therefore in any environment in which gymnastic machines have applications.

SUMMARY OF THE PRESENT INVENTION

The present invention relates to a gymnastic machine to be used for muscular training, having a load group with a high capacity to absorb power, and limited overall dimensions. In particular, the present invention relates to a gymnastic machine to be used for muscular training, provided with a load group with a high capacity to absorb power and limited overall dimensions, and is finely adjustable.

The object of the present invention is to create a gymnastic machine which will permit the resolution of the disadvantages set forth above, and which will be capable of satisfying a series of requirements (which will be presented in the description which follows) to which in the present state of affairs there is no answer. It will therefore be capable of representing a new and original source of economic advantage, able to alter the current market in implements for physical training and rehabilitation.

According to the present invention a gymnastic machine is created, whose principal characteristics will be described in at least one of the claims which follow.

This gymnastic machine has preferably a particularly slim loadbearing structure, usable at will according to the type of exercise which the user desires to perform.

Furthermore, according to the present invention a load group for a gymnastic machine is created, the load group being practical in use and of limited overall dimensions. It includes a device which is usable for finely adjusting the training loads, and simplifies the operations of load adjusting and checking and maintaining both the load group and the machine to which this load group is fitted.

BRIEF DESCRIPTION OF THE DRAWINGS

Further characteristics and advantages of the gymnastic machine according to the present invention will appear more clearly from the following description, explained by reference to the attached drawings which illustrate some non-limiting examples of embodiment, in which identical or corresponding parts of the device itself are identified by the same reference numbers. In particular.

DETAILED DESCRIPTION OF PREFERRED EMBODIMENTS

Figure 1:
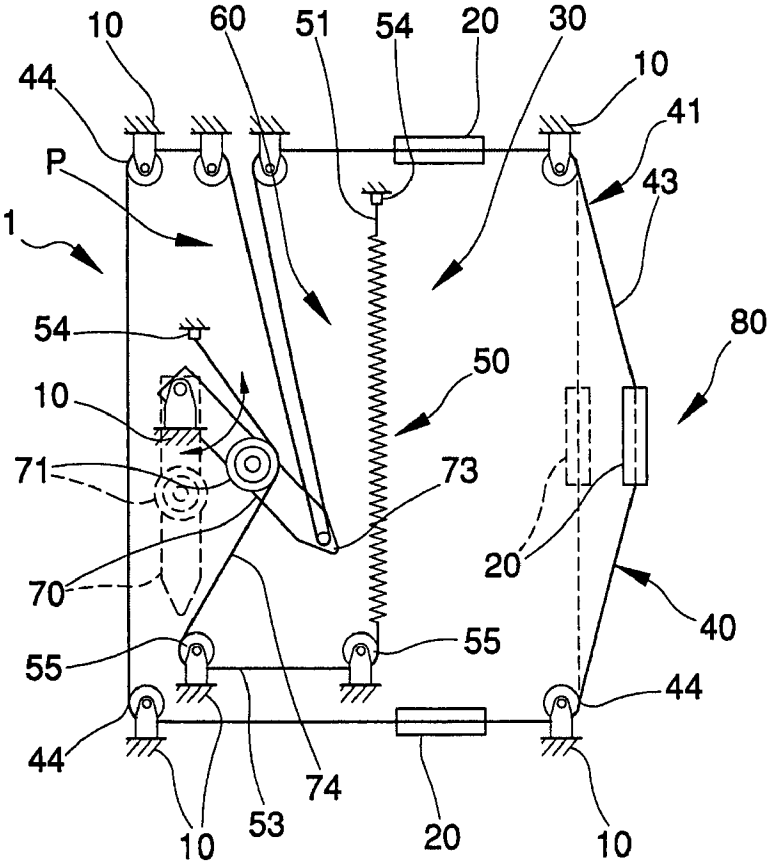
FIG. 1 is a schematic view in lateral elevation of a first preferred embodiment of a gymnastic machine according to the present invention.

In FIG. 1, no. 1 indicates in its entirety a gymnastic machine including at least one respective gymnastic implement 20 supported from frame 10 itself, adjacent to a particular gripping station 80 and in combination with a load group 30, this too being supported from frame 10, to provide a resistive load to each implement 20 during the execution of physical exercises. Load group 30 includes, in its turn, a first circuit 40 and a second circuit 50, both having respective first and second transmission members 41 and 51, and, without this being a limitation, here and hereinafter these will be considered to be of flexible type. Still according to FIG. 1, the first circuit 40 and the second circuit 50 are mechanically coupled to each other by means of at least one lever 70, which is hinged to frame 10 beside a substantially vertical upright of a respective framework, or subframe, 11 of frame 10 itself. It is as well to state that, here and hereinafter, the term "circuit" will be used to indicate open or closed routes followed by cables and flexible members in general.

Each implement 20 is coupled to a first flexible member 41 in the first circuit 40. The second circuit 50 operates in combination with at least one load unit 60 belonging to the load group 30, and capable of exercising a traction-resisting action on first flexible member 41, and therefore of functioning as a device which absorbs the power exerted by the user during the execution of the training exercises. This load unit 60 can be made by exploiting any physical principle, and be of gravitational type, and can therefore be made by using a group of blocks (known and not illustrated), of substantially identical mass or otherwise; or it could be made by using a device of fluid-dynamic type, by means of a single- or double-effect actuator, depending on the requirements of the user; or it could be made by using an elastic member, without mechanically affecting the particular structure of the load group 30 of the gymnastic machine in question. For convenience of representation, but also because in this way an example is provided of how to make load group 30 noiseless, compact and particularly light, the load unit 60 can conveniently include a torsion spring 60 of longitudinal type which is coupled rigidly to the frame 10 by means of the end portions 54 of the second member 51, without this detracting from the generality of the present description. It will be noted that load unit/torsion spring 60 is connected to the end portion 54 located on the side facing towards lever 70, through a substantially inextensible length of cable 53 belonging to the second member 51, diverted through a pulley-block 55 including at least one pulley which, for simplicity, is indicated by the same reference number 55. This pulley 55 is carried by frame 10 itself in freely rotatable manner on the route of second circuit 50.

In particular, the first flexible member 41 includes a cable 43 wound in a loop over a plurality of pulley-block members 44, each of which can include one or more pulleys according to need, without this figurative choice representing a limitation of the present description. The cable 43 is normally made of substantially inextensible material and, furthermore, can carry every implement 20 of every gripping station 80, rigidly or sliding indifferently, as described respectively in patent applications nos. RA2002A000017 and RA2004A000008 by the applicant, to which reference is made for brevity.

The subframe 11 delimits machine 1 to the rear and extends substantially in one plane, even though on different machines it may extend in appropriately oriented planes, according to the relevant specifications. Furthermore, with reference to FIG. 5 in particular, the subframe 11 has a particularly simple and compact shape, given that it includes a substantially rectangular box-like structure.

Figure 3:
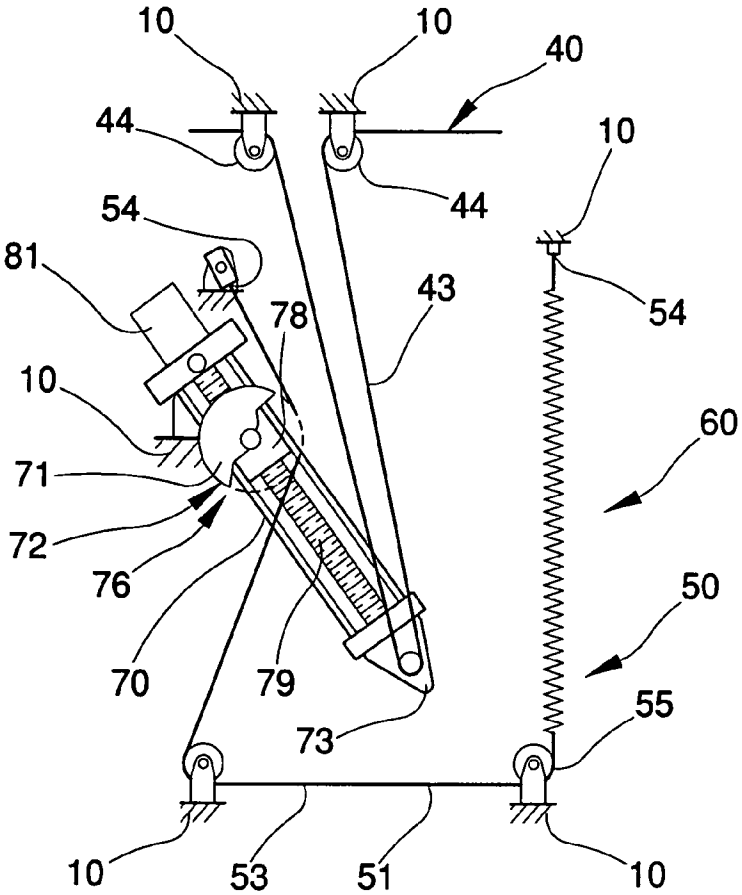
FIG. 3 illustrates on an enlarged scale and with parts removed for clarity a portion taken from FIG. 1.

With reference to FIG. 3, it will be noted that lever 70 is coupled to the cable 43 adjacent to a respective end/head portion 73 in such a way as to activate the load unit 60 mechanically, and therefore to generate traction on cable 43 itself. To this end, the lever 70 freely supports a pulley-block member which includes a pulley 71, which is coupled transversely to the inextensible length 53 of second member 51, through a respective circular groove 72. The pulley 71 is therefore arranged so as to generate a shear, and therefore tangential, action on second flexible member 51. The contact between the groove 72 and the second flexible member 51 is of turning type, with the aim of limiting the dissipation of energy involved in the transmission of movement, but in the event that a greater value for friction between the moving parts were acceptable, pulley 71 could be replaced by a fixed pulley of known and not illustrated type. We will return to this subject further on.

With particular reference to FIG. 1, the second member 51 can cooperate with a spring 60 as described above, and create a body having concentrated mechanical characteristics, connected to frame 10 and wound over pulley-blocks with pulleys 55. On the other hand, the second member 51 could be made by means of a single cable of variable or constant composition and section, possibly running over pulleys as in the other case, but made of substantially elastic material, sized with its at-rest length proportional to the relevant needs. In the latter case, the second member 51 would have distributed mechanical characteristics, without for this reason limiting the scope of the present invention. By virtue of what has been described, it seems clear that the load unit 60 cooperates with the second flexible member 51, and therefore with the respective inextensible length of cable 53, with the end portions 54, and also with the pulley-block 55.

By virtue of what has been described above, by using of cable run 53, it is possible to mechanically interface the first circuit 40 and the second circuit 50, and therefore exchange power between each implement 20 and the load/spring unit 60. It will be noted, in fact, that if traction is exercised by means of any implement 20, through the connection between the cable run 53 and the lever 70, the result will be to cause the rotation of lever 70 around the respective fulcrum axis, and therefore to stress the second flexible member 51 in shear, which will react by opposing the rotation of lever 70, and therefore resisting the traction exerted on the cable 43 by the implement 20 in use. The lever 70 can therefore be interpreted as any modulating member capable of mechanically activating the load-unit 60/spring 60 in such a way as to allow the regulation of the respective intensity in substantially continuous and precise manner. The lever 70 may therefore validly but without limiting effect be replaced by a device which is functionally equivalent and therefore capable of generating a shear action on the flexible member 51. In particular, such an equivalent device could include, alternatively or in combination, for example, an eccentric or a cam carried rotatably by the frame, or a pulley-block movable on a guide carried by the frame.

Figure 6:
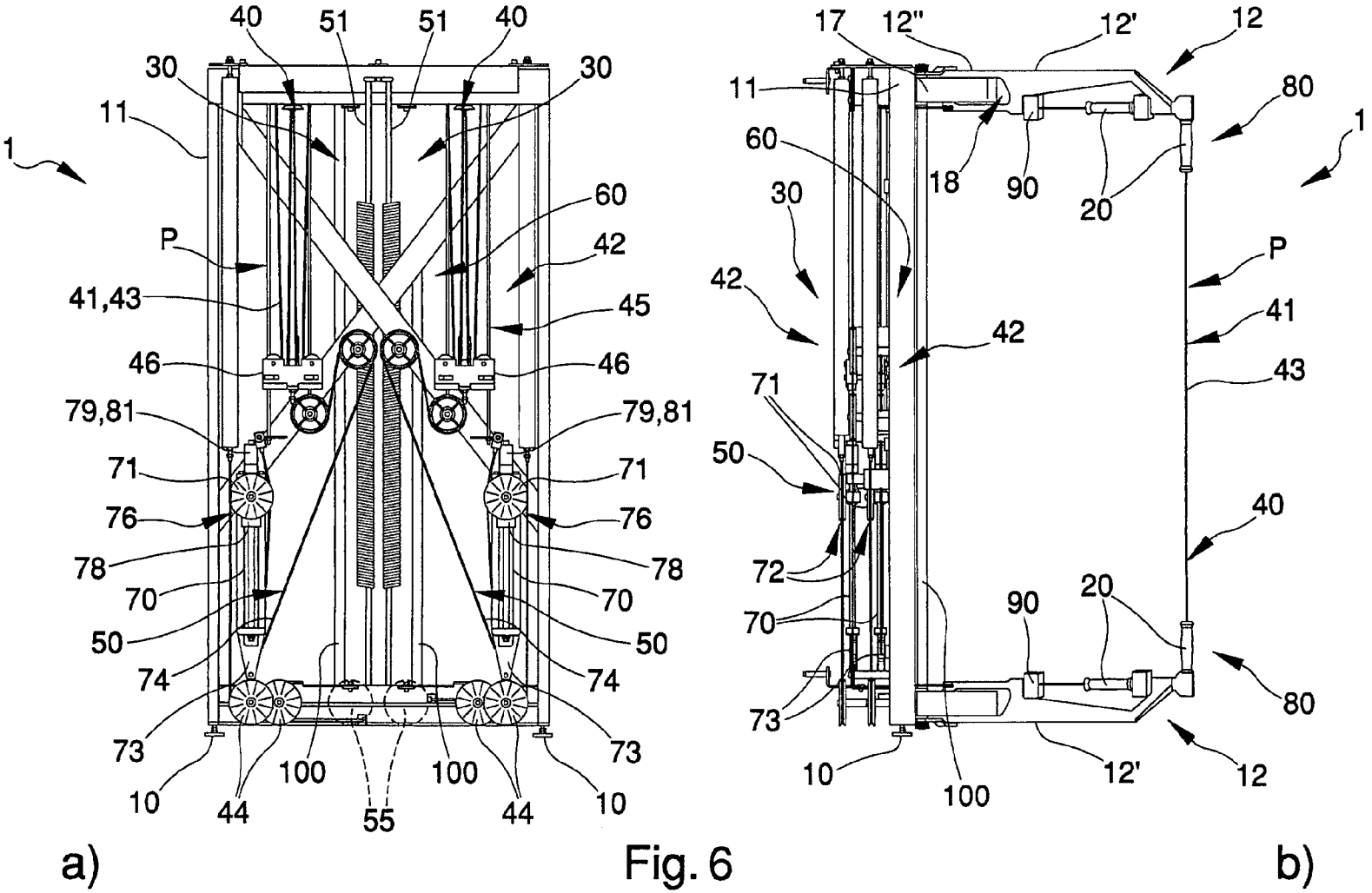
FIG. 6 is a schematic view, on an enlarged scale in rear and lateral elevation, of a rear portion of FIG. 5.

Returning to FIG. 3, the lever 70 is formed in such a way as to make it possible to vary the position of the center of pulley 71 on the lever 70 itself. In particular, the lever 70 includes at least one slide-guide 76 provided with a movable mechanism 78 coupled to the lever 70 itself in longitudinally fixed and selectively sliding manner, and supporting the pulley 71. The movable mechanism 78 is anchored to the thread of a recirculating ball screw carried longitudinally and centrally by the lever 70, for the purpose of regulating the position of the movable mechanism 78 along the lever 70, and maintaining it rigidly. The screw 79 is connected to a rotary actuator 81 of known type, and for this reason only summarily illustrated in FIG. 6*a*; this rotary actuator can be of the type operable manually or electrically, according to market requirements. Naturally, each position chosen for the movable mechanism 78 and the dual pulley 71 will correspond to a particular value for the effort which must be applied to each implement 20 for the execution of the training exercise: this is because it will vary the resistive torque which the second member 51 exerts on the lever 70. To simplify the attached drawings, the connection between the movable mechanism and the lever 70 may be carried out through a screw coupling, in such a way as to enable fine adjustment of the longitudinal position of the movable mechanism 78, and therefore of the pulley 71 with respect to the arm 70. Alternatively, if a decision is made for a simpler but less precise mechanism, consideration could be given to effecting the connection between the movable mechanism 78 and the lever 70 by means of transverse pins. By virtue of what has been described above, the use of machine 1 is easily understandable in the light of the description provided above, and does not require further explanation.

Finally, it is clear that modifications and variations may be made to the machine 1 here described and illustrated without for this reason departing from the protective scope of the present invention.

Figure 2:
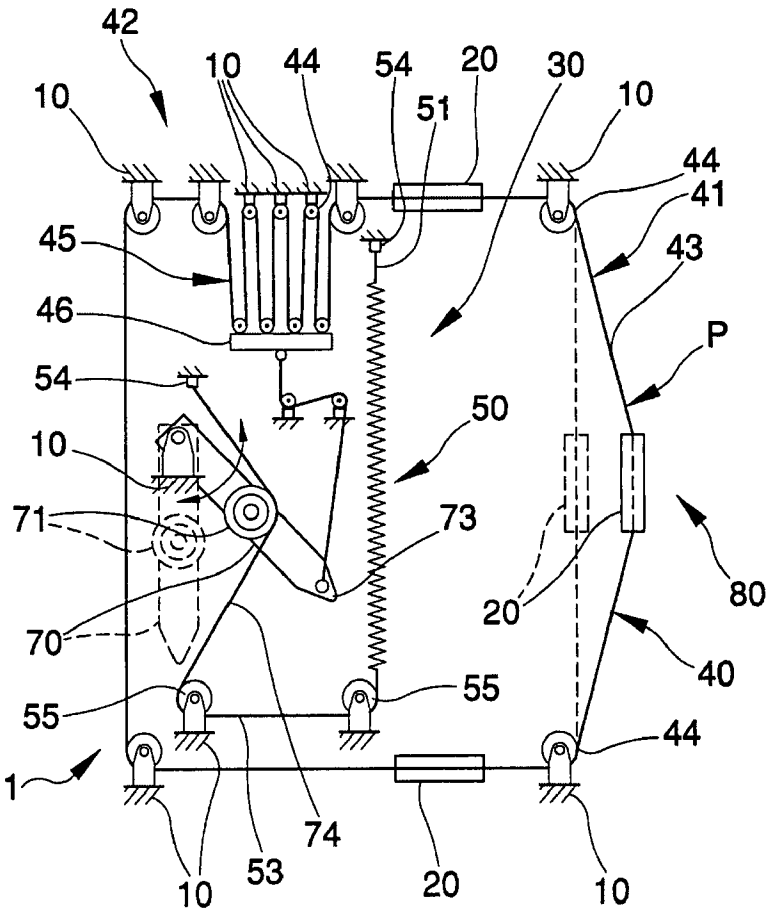
FIG. 2 is a schematic view in lateral elevation of a second preferred embodiment of FIG. 1.

With particular reference to FIG. 2, a machine 1 is described which has the characteristics of the machine 1 of FIG. 1, and which it has been decided to indicate again with the number 1 for convenience, maintaining also the same numbering for the corresponding equivalent components. The machine 1 in FIG. 2 is distinguishable from the machine 1 in FIG. 1 because the first circuit 40 and the second circuit 50 are interfaced with each other by means of a load device 42 engaged by cable 43 and cooperating, as will be better explained below, with the lever 70, for the purpose of reducing the load applied to each implement 20 at constant power, and therefore at the expense of the stroke-length applicable to the corresponding implement 20 during the execution of the exercise, which increases proportionately to the reduction in the load itself. In this way the instantaneous value of the energy applied to the load group 30 remains constant, similarly to what was described in patent application no. RA2002A000017 from the same applicant, to which reference is made for brevity.

In this case also, the cable 43 is wound in a loop over a plurality of pulley-blocks 44 supported by the frame 10 along a route P which, as has been said, is closed, but the load device 42 includes, in addition, a block-and-tackle 45 having a movable mechanism 46 including a plurality of transmission pulleys 44, supported by frame 10 by means of the cable 43, which is wound over the corresponding pulleys 44.

Figure 4:
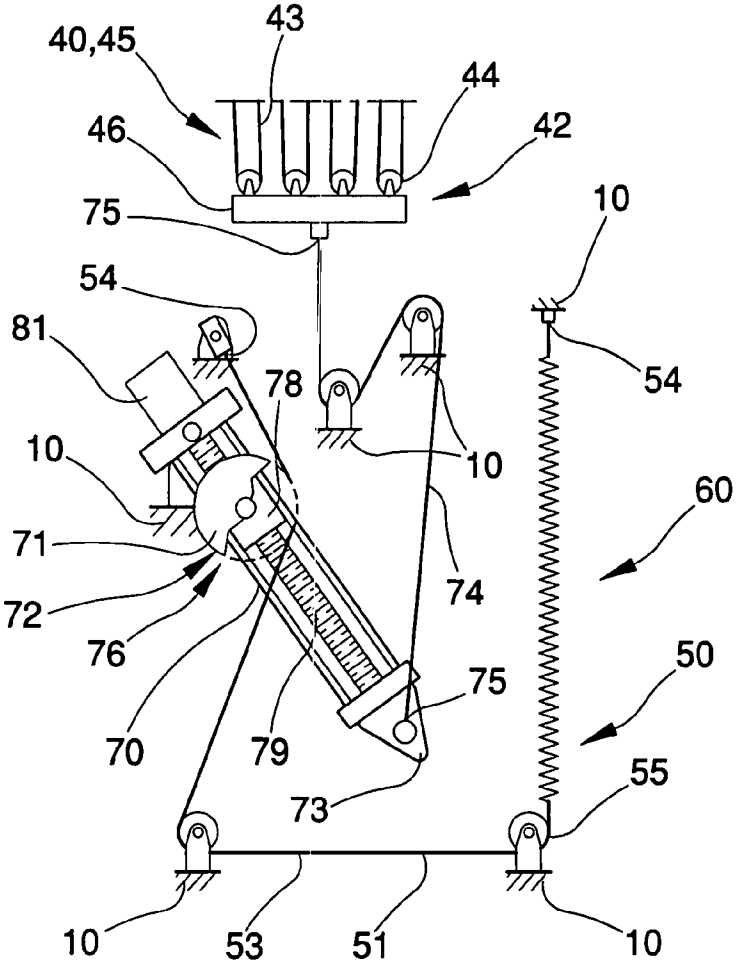
FIG. 4 illustrates on an enlarged scale and with parts removed for clarity a portion taken from FIG. 2.

With reference to FIG. 4, the movable mechanism 46 is mechanically connected to the lever 70, adjacent to a respective end/head portion 73 through a further flexible member 74 which allows the exchange of power between the first circuit 40 and the second circuit 50. This member 74 is wound over at least two pulleys 44 carried by subframe 11 between the respective side uprights and is delimited longitudinally by two respective ends 75, one of which is connected to the movable mechanism 46, and the remaining one to the head 73 of the lever 70.

With particular reference to FIGS. 5-10, a machine 1 is illustrated of double type, in other words one which results from the coupling of two machines 1 illustrated in FIG. 2, arranged side by side, on mutually parallel planes and with the respective load groups 30 partially overlapping in order to contain the overall transverse dimensions. The resulting machine (which it has been decided to indicate still by the number 1, again for convenience, maintaining also the same numeration for the corresponding similar components) is therefore usable for simultaneously training the right-hand side and the left-hand side of a user's body. For this reason, in interpreting the remaining part of the present description, it is advisable to bear in mind that what is stated goes for the right-hand side and the left-hand side of machine 1 itself, considered singly or in its entirety, depending on the context.

Figure 5:
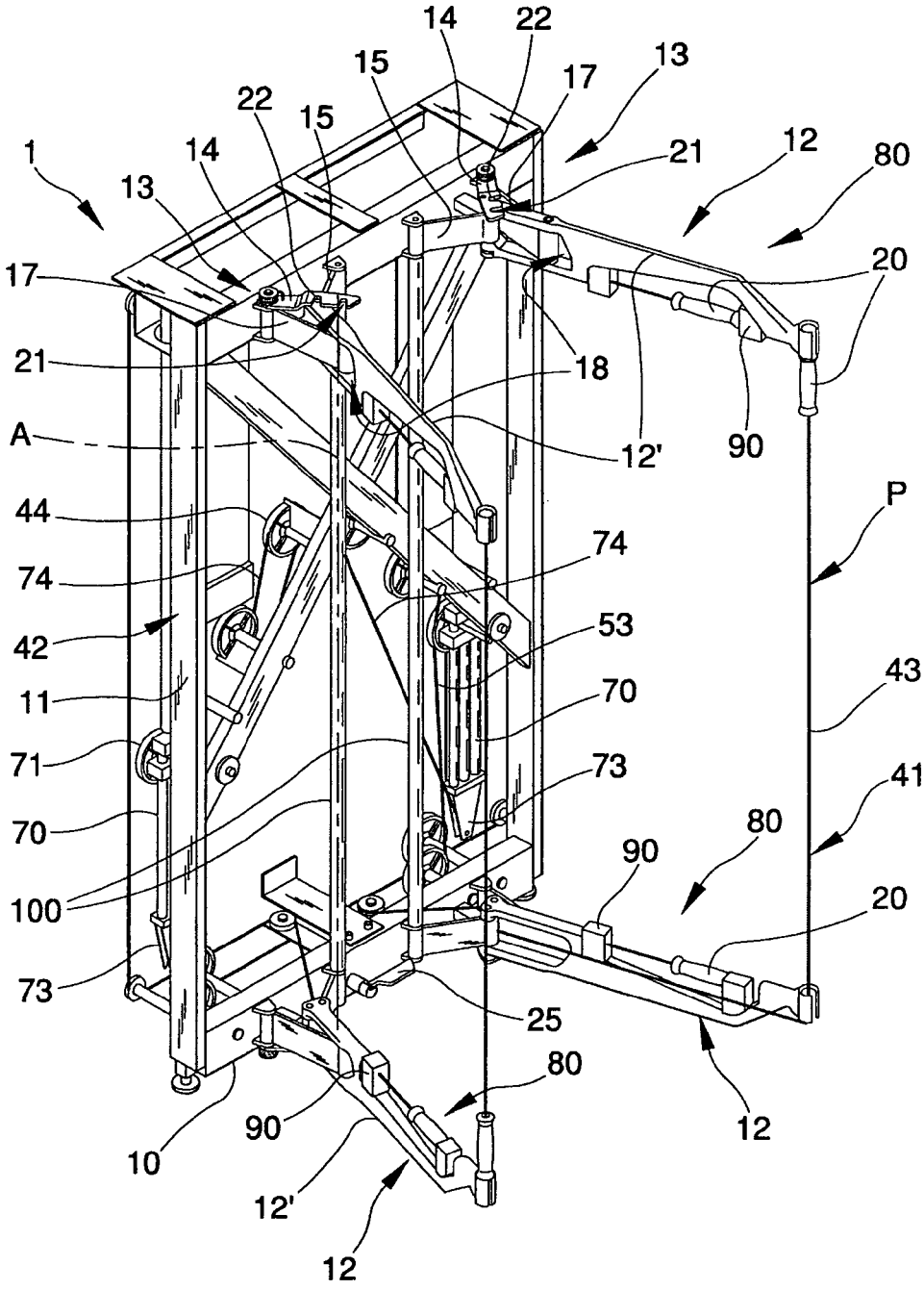
FIG. 5 is a schematic perspective view of a machine whose structure follows the scheme in FIG. 2, with parts removed for clarity.
Figure 7:
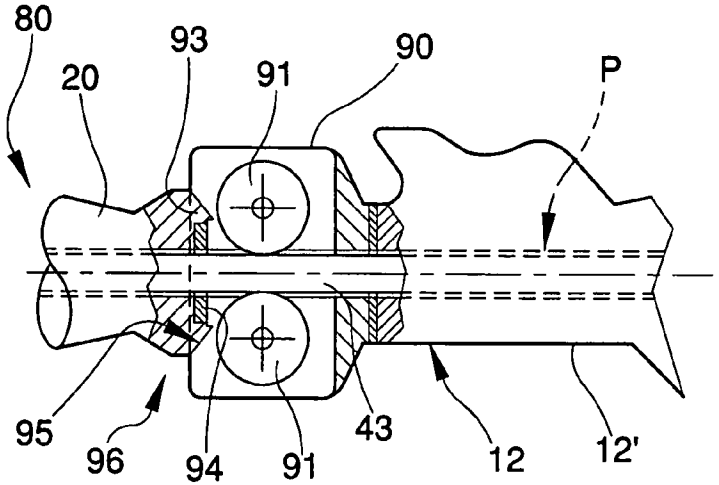
FIG. 7 is a view in lateral elevation, on an enlarged scale, of a second detail taken from FIG. 5.
Figure 8:
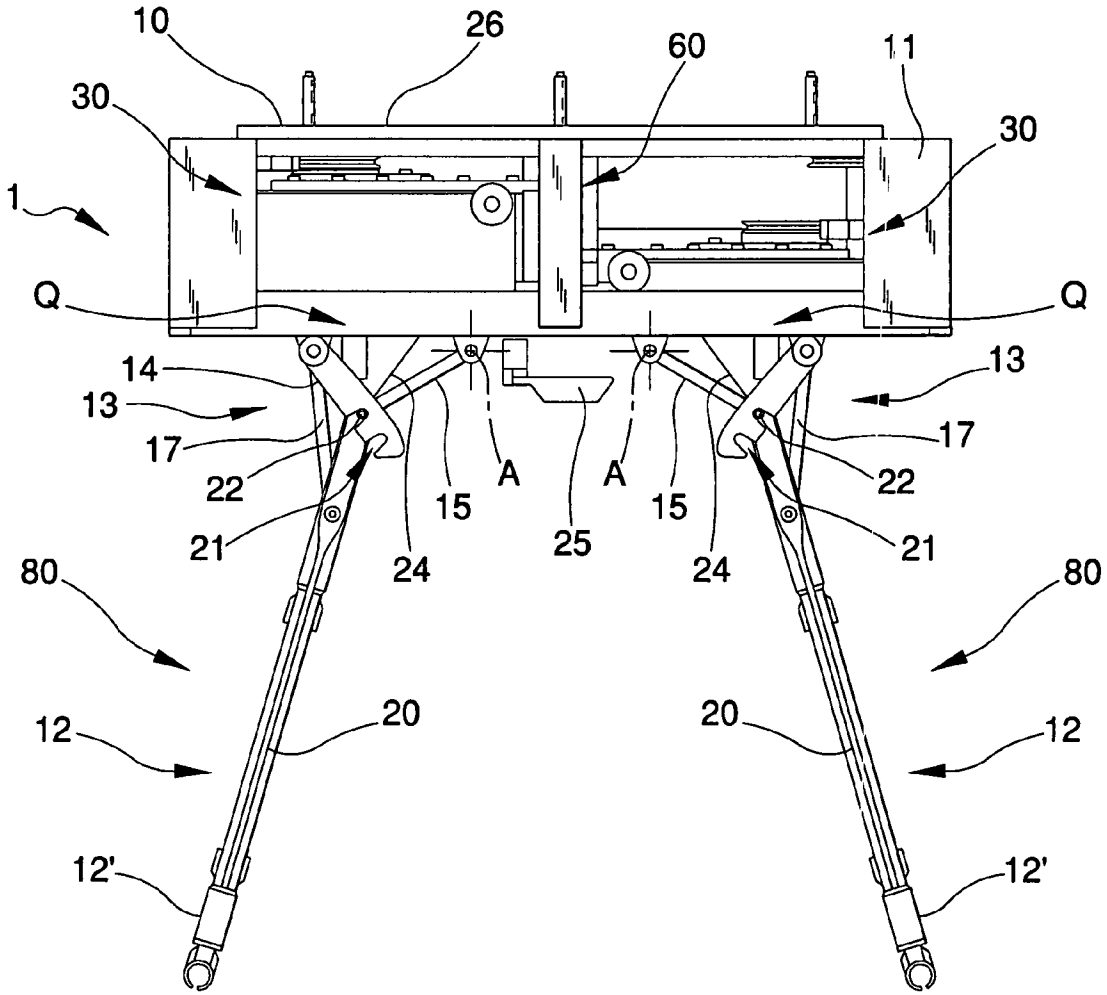
FIG. 8 is a plan view, on an enlarged scale, of FIG. 5.

According to FIG. 5, the machine 1 has at least one leaf 12 connected in freely rotatable manner to the frame 10 and having a plurality of implements 20, organized into at least one gripping station 80. Each leaf 12 includes a pair of first arms 12', arranged parallel to each other and one above the other in a vertical plane to constitute two short sides of the leaf 12, and between them to define the long side of the leaf 12. Each arm 12' is connected swiveling pennant-style to the subframe 11 and rigidly to a rod 100 carried by the subframe 11 freely rotatable around a determinate axis A. This rod 100 is connected to the subframe 11 in a rotationally swiveling manner, in such a way that the two arms 12' coupled through the rod 100 itself are simultaneously orientable pennant-wise at identical angles to each other. This allows the two arms 12' to be inclined as desired with respect to the subframe 11, and therefore provides a gripping station 80 positionable remotely with respect to the subframe 11 at an angle definable at will. In addition, having arms 12' orientable at will with respect to the subframe 11 allows the provision of a machine of extremely compact dimensions, of an order of magnitude comparable with that of the respective subframe 11. Naturally, the vertical orientation of the rod 100 is due to a particular orientation of the arms 12' with respect to the frame 10, and does not represent a limit to the present invention. By virtue of what has been described above, each arm 12' is usable for diverting the cable 43 outside the subframe 11 along a substantially U-shaped route through the respective articulated pulley members 90 of known type, each of which is carried by the respective arm 12' adjacent to the respective stations 80, and freely rotatable around a determinate axis, substantially coinciding with the axis of the relative run of cable 43 if subjected to traction. With particular reference to FIG. 7, each pulley member 90 has a fork-shaped arrangement and houses a pair of pulleys 91 arranged on opposite sides around the cable 43, and is coupled to the respective arm 12' in a freely rotatable manner and oriented according to the corresponding cable run 43. By virtue of what has been described, the machine 1 is of functional type, and allows the execution of exercises with free articular movements, definable at will from time to time, to allow training with specific actions, even of work-related type. Each leaf 12 includes, connected to each arm 12', a safety mechanism 13 capable of keeping the arm 12' itself rigidly in at least one determinate position with respect to the subframe 11 of the frame 10. To this end, each safety mechanism 13 includes a locking member 14 commutable by snap action, which will be better described in what follows. Each mechanism 13, furthermore, includes a first equalizer 15 which is hinged to the subframe 11 and connected to the arm 12' in freely rotatable manner, and axially fixed to a respective end portion in the direction facing towards the subframe 11; and a second equalizer 17, this too being hinged to the subframe 11 and to the arm 12'. Each arm 12' has, furthermore, a longitudinal slot 18, which is capable of housing a portion of the first equalizer 15 in such a way as to permit partial interpenetration between this first equalizer 15 and the respective arm 12', and thus to permit the latter to assume a rest position in which the arm 12', and therefore the corresponding leaf 12', are located substantially parallel to a rear wall 26 of the subframe 11, indicated in FIGS. 8 and 9.

Provided always that it is considered necessary, slot 18 can be provided with a cover suitable for preventing involuntary insertion of fingers or other limb extremities and the consequent risk of severing them. By virtue of what has been described above, the assembly of the frame 10 and the two equalizers 15 and 17 forms an articulated quadrilateral Q, which determines the modality of movement of the leaf 12 with respect to the subframe 11. Still by virtue of what has been described above, each leaf 12 is movable like the two corresponding quadrilaterals Q, and lockable like the corresponding arms 12' with respect to the subframe 11 itself.

Figure 9:
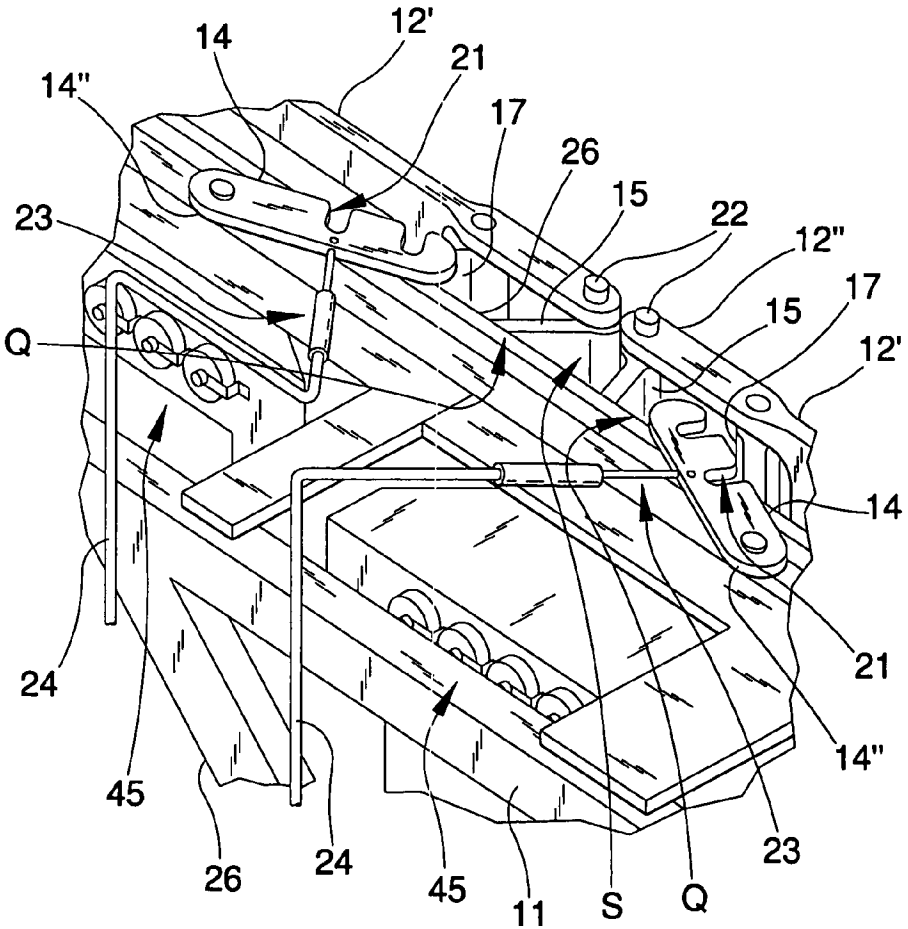
FIG. 9 is a first schematic perspective view, on an enlarged scale and with parts removed for clarity, of a rear portion of FIG. 8.
Figure 10:
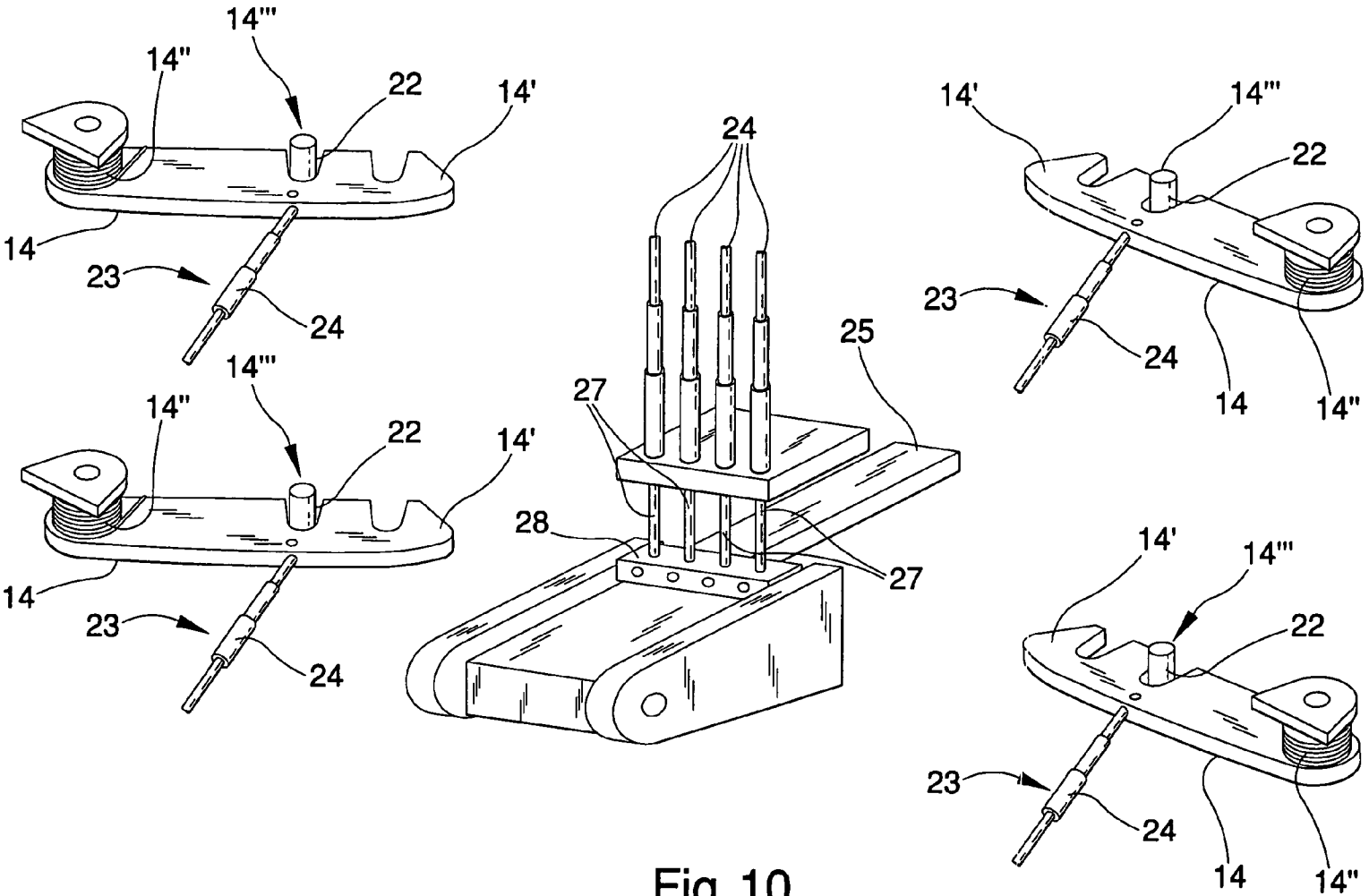
FIG. 10 is a second schematic perspective view, on an enlarged scale and with parts removed for clarity, of a rear portion of FIG. 8.

In addition it should be noted, still with reference to FIGS. 5 and 10, that the locking member 14 includes a lever indicated for convenience with the same number 14 and hinged frontally to the subframe 11, coaxially with the second equalizer 17. Each lever 14 has a plurality of transverse housings 21, visible only in FIG. 9, suitable for stably accommodating a coupling pin 22, suitably curved to take up backlash. Each pin 22 is carried transversely by arm 12'. In this way it is possible to connect each pin 22 stably to the subframe 11 and, consequently, also the corresponding arm 12', eliminating the excessive degree of constraint which characterizes the coupling between each leaf 12 and the frame 10. The stability of the coupling between each pin 22 and the respective transverse housing 21 is ensured by the fact that each housing 21 is suitably curved to allow the take-up of the backlash in the respective coupling. Each lever 14 has a respective end portion 14' capable of functioning as a profile for controlling the deformation of a spring 14" located between the body of lever 14 and the frame. In use, the movement of each arm 12' from the rest position to an operating position, in which it is suitably inclined with respect to the frame 10, carries the periphery of pin 22 into contact with the external surface of the end portion 14' of the lever 14, and allows the deformation of the spring 14" itself until the motion of capturing the pin 22 on the periphery of the portion 14' in cooperation with the spring 14" brings about the return action, allowing pin 22 access to the inside of the transverse housing 21.

Each safety mechanism 13 is connected to a circuit 23 visible in FIG. 9 and including Bowden or similarly functioning cables 24, which are operable simultaneously through a single actuating member. In particular, each cable 24 is operable by means of a pedal 25, carried frontally by the frame 10, as appears from FIGS. 5, 8 and 10, which is capable of controlling the unlocking of each safety mechanism 13, and in particular of bringing about the retraction of the lever 14, and therefore the release of the corresponding arm 12', which can be repositioned at rest, parallel to the rear portion wall 26 of the machine 1 itself. Furthermore, the pedal 25 receives an end 27 of each cable 24 through a common reference element 28, whose function is to unite these ends 27 before the pedal 25.

By virtue of what has been described above, and with particular reference to FIGS. 9 and 10, the assembly of lever 14 and the set consisting of the pin 22 and the end portion 14' of the lever 14 itself, constitutes a cam-and-follower device 14'" releasable by pedal, capable of bringing about the locking and selectively the unlocking of leaves 12 from the respective inclined position and thus the position in use.

According to FIG. 7, at least one of the pairs which include an implement 20 and a pulley member 90, located in at least one of the gripping stations 80 located along the cable 43, includes at least one shank 93 formed in the implement 20 on the side facing a corresponding pulley-block 90, the shank being fitted with an annular plate 94. This plate 94 is carried rigidly in an end position by the shank 93 on the side facing towards the portion of free end of the corresponding arm 12'. The object of this plate 94 is to restrain the corresponding implement 20 along the first circuit 40/route P in at least one uniquely determinate position. To this end, pulley-block 90 presents, on the side facing implement 20, a conical housing 95 profiled in conjugate manner to the shank 93, in such a way as to allow the automatic alignment of the corresponding implement 20 with respect to the frame 10, and in particular with respect to the ideal line traced by cable 43 at rest in the corresponding gripping station 80. This allows machine 1 to be offered always in the same configuration at the end of a previous use, and thus in the situation in which at least one implement 20 connected in freely sliding manner to the cable 43 in a particular station 80 is made available always at the same point and in the same way, with the aim of facilitating the return to position of the implement 20 at the resumption of training on the same machine 1. By virtue of what has been described above, every implement 20 fitted with the respective plate 94 can be provided in conditions of use in contact with the respective housing 95, without the direct intervention of a user being required, but through the simple application of traction at any point on the cable 43 itself by means of any other implement 20 on the same or the other leaf 12, or in any other way, possibly during the continuation of the training session on the same machine 1. This final setting-up of the machine 1 could therefore even be mechanized, using a device which puts the cable in traction on the side of implement 20 which was last used.

Naturally, this mode of operation could also be achieved if the plate 94 was connected to the housing 95, and also if either the shank 93 of the implement 20 or the corresponding housing 95 were made of magnetic material and suitably oriented to attract each other.

This particular capability certainly comes in useful in the situation in which a user is engaged in the execution of a considerable number of repetitions of an exercise on the same machine 1, and also for facilitating the use by a visually impaired user of the machine 1 with implement 20 carried sliding on cable 43. Besides, the presence of magnetically active or sensitive parts allows the elimination, right from the start, of the problem of having implements 20 which, if left to themselves, could weigh on cable 40 itself, producing banging noises and disturbing the user who is in training For this reason, every assembly including an implement 20, the corresponding shank 93, a pulley-block 90 having a respective housing 95 for the end of implement 20, this end being fitted with plate 94 itself, can be defined as a centering device 96, and therefore a silencer, for functional machines having several gripping stations 80 which are provided with implements 20 freely sliding on cable 43 itself and operable by dragging on implement 20 itself. In addition, the same assembly can be interpreted as a device 96 for automatic restoration of a particular configuration, a device which is operable for pulling the implement 20 itself, and could be capable of cooperating directly with the frame 10 instead of with the frame through the medium of pulley-block 90.

It should be noted that it has been decided to leave each quadrilateral Q free with the respective leaves 12 in the rest position, to avoid the possibility of an accidental outward rotation of at least one of the arms 12' causing a reduction in the space S which, small though it is, has been left on purpose between the heads 12" of the arms 12' restrained by the equalizers 15.

This decision avoids the possible occurrence of the crushing of a limb or of any other part of the body of a user who finds him/herself by chance in a space S between the two ends of arms 12' when one of them is unexpectedly displaced towards the other. In particular, the possible presence of any part of the body of a user in a space S would cause the transmission of the displacement of the dual arm 12' of the other quadrilateral Q through the medium of the same bodily region in substantial absence of resistive forces, and thus without traumatic consequences for the part of the body itself.

However, it is as well to state that through appropriate sizing of the load group 30, machine 1 allows load spectra to be obtained at the implements 20 which faithfully reproduce gravitational loads.

Naturally this represents a great advantage and confers on machine 1 a series of singularly innovative properties, one of which is precisely the reduction in overall dimensions at rest, given the possibility of providing a considerable number of gripping stations 80, each fitted with at least one implement 20; the load group 30 too is particularly easy to use and finely adjustable, in order to cater for the need to execute personalized training including the aspect of what load values may be selected; the load group 30 is also particularly robust, being entirely mechanical and free of suspended weights, and for this reason also effectively silent; the arms 12' are repositionable in the position facing the subframe 11 at the end of the exercise, in such a way as to minimize the overall dimensions of the machine 1 at rest; the absence of weights allows the structure of machine 1 to be made particularly light; the possibility of having implements coupled to the cable 43 in freely sliding manner, and of having magnetic restraint members, allows machine 1 to be made easily usable even by users who are visually impaired or have difficulties with movement, since it allows the implement to be presented in the most suitable location for gripping by the user. By virtue of what has been described above, the use of machine 1 is easily comprehensible, even in the last version, in the light of the description provided above, and does not require further explanation.

It is anyway clear that modifications and variations may be made to the machine 1 described and illustrated above, without for this reason departing from the protective scope of the present invention

What is claimed is:

1. Gymnastic machine (1) comprising a frame (10), at least one gymnastic implement (20) supported by said frame (10) to provide, in association with a load group (30), a resistive load to said at least one implement (20) during the execution of a physical exercise; wherein said load group (30) includes a first circuit (40) and a second circuit (50), both having respective first and second transmission members (41) (51);

each said first and second transmission members (41) (51) including a flexible member (41) (51);

said at least one implement (20) being coupled to a first transmission member (41) for said first circuit (40) and said second circuit (50) including at least one load unit (60) capable of exerting a resistive action on said first transmission member (41);

said first circuit (40) and said second circuit (50) being interfaced mechanically with each other through modulating means (70) capable of mechanically activating said at least one load unit (60) to regulate its intensity in a substantially continuous manner;

said modulating means (70) including at least one modulating element (71) capable of generating a shear action on said second circuit (50);

wherein said at least one modulating element (71) supports a pulley member (71) having respective tangential coupling means (72) interfaceable with said second circuit (50) adjacent to a respective transmission member (51) to activate said load unit (60).

2. Machine according to claim 1, wherein the modulating means (70) includes at least one modulating element (71) capable of generating a shear action on said second transmission member (51).

3. Machine according to claim 1, wherein said modulating means (70) further includes a lever (70) hinged to said frame (10) and having at least one said pulley member (71) to couple transversely to said first transmission member (41) in such a way as to be freely operable by said first transmission member (41) against the resistance of said load unit (60).

4. Machine according to claim 3, wherein said load unit (60) is capable of cooperating with said second circuit (50) to exert said resistive action, and that each said pulley member (71) has respective tangential coupling means (72) interfaceable with said second circuit (50) adjacent to a respective transmission member (51) to activate said load unit (60).

5. Machine according to claim 4, wherein said load unit (60) includes a determinate member (60) located along said second circuit (50) and presenting mechanical characteristics of substantially elastic nature.

6. Machine according to claim 5, wherein said elongated member (60) includes a spring (60).

7. Machine according to claim 5, wherein said at least one implement (20) is coupled to said first transmission member (41); said second transmission member (51) including a second substantially inextensible run (53) located in series with said spring (60) and coupled transversely to a first pulley (71) belonging to said pulley member (71).

8. Machine according to claim 7, wherein said first circuit (40) includes a load device (42) located between said first transmission member (41) and said lever (70) to reduce the load acting on said at least one implement (20).

9. Machine according to claim 8, wherein said first transmission member (41) includes a cable (43) wound over a plurality of first pulley-blocks (44) supported by said frame (10) along a closed route (P); said first load device (42) including a first movable mechanism (46) supported by said frame (10) by means of said cable (43).

10. Machine according to claim 9, wherein said load device (42) includes, in combination with said first movable mechanism (46), a block-and-tackle (45) having a plurality of second pulleys (77), some of them being supported by said movable mechanism (46).

11. Machine according to claim 7, wherein said first transmission member (41) includes a cable (43) wound in a loop round a plurality of first pulley-blocks (44) supported by said frame (10) along a closed route (P); said first load device (42) including a first movable mechanism (46) supported by said frame (10) by means of said cable (43).

12. Machine according to claim 4, wherein said load unit (60) includes a determinate member (60) located along said second circuit (50) and presenting mechanical characteristics of substantially fluid-dynamic nature.

13. Machine according to claim 4, wherein said load unit (60) includes a determinate member (60) located along said second circuit (50) and presenting mechanical characteristics of substantially gravitational nature.

14. Machine according to claim 3, wherein said pulley member (71) is connected to said lever (70) in longitudinally sliding manner, to enable the regulation of said resistive action on said at least one implement (20).

15. Machine according to claim 14, wherein said second transmission member (51) is coupled to said frame (10) by means of respective end portions (54).

16. Machine according to claim 3, wherein said lever (70) includes a slide-guide device (76) having a second movable mechanism (78), longitudinally and selectively connectable in rigid manner to regulate the longitudinal position of said first pulley (71).

17. Machine according to claim 16, wherein said lever includes operating means (79) for said second movable mechanism (78) including at least one threaded member (79).

18. Machine according to claim 17, wherein said operating means (79) includes a rotary actuator (81) mechanically coupled to said threaded member (79).

19. Machine according to claim 1, wherein said modulating means (70) includes at least one lever (70) hinged to said frame (10) and coupled transversely to said first transmission member (41) through at least one pulley member (71) in such a way as to be freely operable by said first transmission member (41) against the resistance of said load unit (60).

20. Machine according to claim 1, further comprising return means (94) connected to said at least one implement (20) or to a respective pulley-block (90) to draw and restrain said at least one implement (20) along said first circuit (40) in at least one determinate position with respect to said frame (10), in such a way that said at least one implement (20) is, in use, returnable in repeatable manner.

21. Machine according to claim 20, wherein said return means (94) includes at least one magnetic or similarly functioning member (94), couplable directly or indirectly with said frame (10).

22. Machine according to claim 21, further comprising centering means (96) capable of cooperating with the corresponding said at least one implement (20) to align and keep aligned, in use, said at least one implement (20) and said cable (43) by means of a pulley-block (90).

23. Machine according to claim 1, wherein said first circuit (40) includes a cable (43) wound over a plurality of first pulley-blocks (44) supported by said frame along a determinate route (P) and engaged in sliding manner by said at least one implement (20); said frame (10) presenting a subframe (11) and at least one first arm (12') carried by said subframe in freely rotatable manner around a determinate axis (A), and connectable in selectively rigid manner to the subframe (11) itself; said arm (12') being usable for positioning said at least one implement (20) in at least one determinate position with respect to said subframe (11) of said frame (10) in such a way as to allow the execution of exercises of a type definable at will.

24. Machine according to claim 1, wherein said first circuit (40) includes a cable (43) wound in a loop round a plurality of first pulley-blocks (44) supported by said frame (10), along a determinate route (P) and engaged in sliding manner by said at least one implement (20); said frame (10) presenting a subframe (11) and at least one first arm (12') carried by said subframe (11) in freely rotatable manner around a determinate axis (A) and connectable in selectively rigid manner to subframe (11) itself; said arm (12') being usable for positioning said at least one implement (20) in at least one determinate position with respect to said subframe (11) of said frame (10) in such a way as to allow the execution of exercises of a type definable at will.

25. Machine according to claim 24, wherein said arm (12') is coupled to said subframe (11) through a safety device (13) fitted with a locking member (14) capable of securing said arm (12') in at least one determinate position.

26. Machine according to claim 25, wherein said safety device (13) includes a first equaliser (15) connected to said arm (12') in a respective end portion (16) on the side facing said subframe (11), and a second equaliser (17), coupled to said arm (12') in freely rotatable manner.

27. Machine according to claim 26, further comprising a cam-and-follower device (14''') capable of bringing about selectively the locking and unlocking of each said arm (12') in each said determinate position.

28. Machine according to claim 25, wherein each said safety device (13) is connected to a circuit (23) controlling the position of said locking member (14) including Bowden or similarly functioning cables (24), capable of selectively causing the actuation of said locking member (14) from and towards a position of rigid coupling with a coupling pin (22) carried by the corresponding said arm (12') to secure the arm (12') itself in at least one determinate position.

29. Machine according to claim 28, wherein said Bowden or similarly functioning cables (24) are operable simultaneously through a single actuating member.

30. Machine according to claim 25, wherein said locking member (14) is coupled to said subframe (11) coaxially with said second equaliser (17) and has a plurality of transverse housings (21), each of which is capable of transversely housing said coupling pin (22), in such a way as to isostatically connect the corresponding said arm (12') to said flat portion (11).

31. Machine according to claim 30, wherein said frame (10) carries at least one second arm (12') connected to said subframe (11) in substantially identical manner to said first arm (12') and connected to the latter by means of a rod (100) parallel to said determinate axis (A) in rotationally fixed manner, in such a way as to be orientable like the corresponding said first arm (12') with respect to said subframe (11) similarly to a rotating leaf (12).

32. Machine according to claim 1, further comprising a silencing device (95) connected to at least one of the said gripping stations (80) and capable, in use, of bringing about the absence of vibrations from said at least one respective implement (20), coupled in freely sliding manner on said cable (43); said silencing device being operable by dragging of said at least one implement (20) itself on said cable (43).

33. Machine according to claim 1, further comprising a restoring device (95) for a particular configuration, said restoring device (95) being connected to at least one of the said gripping stations (80) and capable, in use, of bringing about the restoration through dragging of at least one particular configuration of a respective said implement (20) itself in a determinate position on said cable (43).

34. Load group for a gymnastic machine (1) described with reference to claim 1, said load group (30) being capable of providing resistive load during the execution of a physical exercise; further comprising a first circuit (40) and a second circuit (50), both having respective transmission members (41) (51); at least one apparatus (20) being coupled to a first transmission member (41) for the first circuit (40); said second circuit (50) including at least one load unit (60) capable of exerting a resistive action on said first transmission member (41); said first circuit (40) and said second circuit (50) being interfaced mechanically with each other through modulating means (70) capable of mechanically activating said load unit (60) to regulate its intensity;

wherein said modulating means (70) includes at least one lever (70) hinged to said frame (10) and coupled transversely to said first transmission member (41) in such a way as to be freely operable by said first transmission member (41) against the resistance of said load unit (60).

35. Group according to claim 34, wherein said second transmission member (51) is capable of cooperating with said load unit (60) and that said lever (70) supports a pulley member (71) having respective tangential coupling means (72) to be interfaced with said second transmission member (51) and elastically activate said load unit (60).

36. Group according to claim 35, wherein said at least one implement (20) is coupled to said first transmission member (41); said second transmission member (51) including a second substantially inextensible run (53) located in series with said load unit (60) and coupled transversely to a second pulley (71) belonging to said pulley member (71).

37. Group according to claim 36, wherein said first circuit (40) includes a load device (42) located between said first transmission member (41) and said lever (70) to reduce the load acting on said at least one implement (20).

38. Group according to claim 37, wherein said first transmission member (41) includes a cable (43) wound in a loop round a plurality of pulley-blocks (44) supported by said frame (10) along a closed route (P); said first load device (42) including a first movable mechanism (46) supported by said frame (10) by means of said cable (43).

39. Group according to claim 38, wherein said load device (42) includes, in combination with said first movable mechanism (46), a block-and-tackle (45) having a plurality of pulleys (77), some of them being supported by said movable mechanism (46).

40. Group according to claim 34, wherein said pulley member (71) is connected to said lever in a longitudinally sliding manner, to enable the regulation of said resistive action on said at least one implement (20).

41. Group according to claim 40, wherein said second transmission member (51) is coupled rigidly to said frame (10) by means of respective end portions (54).

42. Group according to claim 34, wherein said lever (70) includes a slide-guide device (76) having a second movable mechanism (78), longitudinally and selectively connectable in rigid manner to regulate the longitudinal position of said second pulley (71).

43. Group according to claim 42, wherein said lever includes actuating means (79) for said second movable mechanism (78) including at least one threaded member (79).

44. Group according to claim 43, wherein said actuating means includes a rotary actuator (81) mechanically coupled to said threaded member (79).

45. Gymnastic machine (1) comprising a frame (10), said machine including at least one implement (20) and a load group (30) supported by said frame (10) and usable by a user for the execution of a physical exercise; said load group (30) having at least one cable (41) wound over a plurality of pulley-blocks (44) along a particular route (P); wherein said load group (30) includes at least one substantially elastic member (50) mechanically connected to said cable (41) through the interposition of modulating means (70) to exercise a resistive action on the cable (41) itself;

wherein said modulating means (70) includes at least one lever (70) hinged to said frame (10) in order to be rotatable under the action of said cable (41) against the resistance of said at least one substantially elastic member (50) to modulate the resistive action in a predetermined manner.

* * * * *